US006358079B1

(12) United States Patent
Noble

(10) Patent No.: US 6,358,079 B1
(45) Date of Patent: Mar. 19, 2002

(54) PRINTED CIRCUIT CARD RETENTION MECHANISM

(75) Inventor: Scott L. Noble, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/224,608

(22) Filed: Dec. 31, 1998

(51) Int. Cl.[7] ..... H01R 13/62
(52) U.S. Cl. ..... 439/328; 439/326
(58) Field of Search ..... 439/328, 327, 439/326, 325, 350, 357, 79, 80, 629, 630, 633, 371, 157, 377, 637; 361/759, 801

(56) References Cited

U.S. PATENT DOCUMENTS

| | | | | |
|---|---|---|---|---|
| 4,327,835 A | | 5/1982 | Leger | |
| 4,525,771 A | | 6/1985 | Hänseler et al. | |
| 4,826,447 A | * | 5/1989 | Forker et al. | 439/325 |
| 4,917,624 A | * | 4/1990 | Yu | 439/326 |
| 5,218,519 A | | 6/1993 | Welch et al. | |
| 5,319,524 A | | 6/1994 | Welch et al. | |
| 5,406,455 A | | 4/1995 | Devenish, III | |
| 5,477,426 A | | 12/1995 | Bethurum | |
| 5,515,240 A | | 5/1996 | Rodeffer et al. | |
| 5,533,631 A | | 7/1996 | Marchetti | |
| 5,563,770 A | | 10/1996 | Bethurum | |
| 5,563,771 A | | 10/1996 | Bethurum | |
| 5,580,203 A | | 12/1996 | Read et al. | |
| 5,593,036 A | | 1/1997 | Dyble et al. | |
| 5,603,628 A | | 2/1997 | Schapiro, Jr. | |
| 5,650,917 A | | 7/1997 | Hsu | |
| 5,660,557 A | * | 8/1997 | Lemke et al. | 439/328 |
| 5,726,859 A | * | 3/1998 | Khadem et al. | 361/760 |

* cited by examiner

*Primary Examiner*—Brian Sircus
*Assistant Examiner*—Chandrika Prasad
(74) *Attorney, Agent, or Firm*—Kenyon & Kenyon

(57) ABSTRACT

A printed circuit card retention mechanism is presented that maintains electrical connection by securing an electrical connector of a printed circuit card to an electrical connector of a main circuit board in a piece of electronic equipment. The retention mechanism has a base and at least one pivot arm extending from the base. The base fastens directly onto (i.e., fits over) the electrical connector of the main circuit board. The at least one pivot arm has a finger that extends towards the printed circuit card and fits into notches either cut into or cut through the printed circuit card. While the connector on the printed circuit card is electrically mated to a connector mounted on the main circuit board, the fingers of the retention mechanism latch into notches located on the printed circuit card to ensure the electrical connection between the printed circuit card and main circuit board is maintained when physically moving the piece of electronic equipment.

17 Claims, 6 Drawing Sheets

PRINTED CIRCUIT CARD RETENTION MECHANISM

FIELD OF THE INVENTION

The present invention relates to a printed circuit card retention mechanism, and more particularly, to a retention mechanism that secures an electrical connector (or card edge finger) on the printed circuit card to an electrical connector mounted on a main circuit board.

BACKGROUND INFORMATION

Today, printed circuit cards are used in many electronic devices, such as computers and telecommunications equipment. In these devices, printed circuit cards are often electrically connected to a main circuit board using connectors that extend from the printed circuit card that mate with connectors located on the main circuit board.

In conventional personal computers (PC's), for example, the main circuit board is generally referred to as the motherboard. The electrical connector located on the motherboard in a PC is generally referred to as a card slot and can receive a variety of printed circuit cards that support, among other things, video displays, serial interface ports, parallel interface ports, computer memory (Random Access Memory; RAM) and additional data storage. Many of the printed circuit cards provide input and output apparatus disposed generally on one or more sides of the printed circuit card for connection to external equipment as well as other components internal to the electronic device. Indicator lamps and displays are often disposed on an external face of the printed circuit card to indicate equipment status.

In the computer equipment, the printed circuit card electrically mates with the main circuit board when it is installed in a card slot with the printed circuit card connector mated to the main circuit board connector. Printed circuit cards are usually held in place with a fastening device, such as a screw, installed at one end of the card. Even with this fastening device, printed circuit cards are very sensitive to motion and a small degree of motion can dislodge a card and result in equipment malfunction.

Although a manufacturer tests the equipment prior to shipping, cards may partially dislodge during shipping and handling and result in subsequent malfunction. The loss of electrical contact that results from partially dislodged cards is often difficult to diagnose because only some of the electrical contacts between the printed circuit card and the main circuit board are lost. Thus, connection between the circuit card and the main circuit board is not completely lost but only impaired, which can be difficult to diagnose. This often leads to calls from dissatisfied customers requesting manufacturer assistance in debugging equipment failures. This extended involvement with the customer increases manufacturer costs and decreases customer confidence in the underlying equipment.

Several patents have issued in an attempt to cope with some of these problems. For example, U.S. Pat. No. 5,603,628, issued to Schapiro, Jr. on Feb. 18, 1997, relates to a retainer for printed circuit cards that combines a set of anchors located on both sides of a connector and an adjustable tie device, (i.e., tie-wrap), that extends around both sides of the card and engages the connector to secure the card to the connector. The adjustable tie device allows the retainer to be used with cards of different height. However, because the tie device extends over both sides of the printed circuit card, it invariably rests on the various printed circuit card components that are necessary for the proper functioning of the card. As a result, repeated connection and disconnection of the tie device may damage the card.

Another example, U.S. Pat. No. 5,650,917, issued to Hsu on Jul. 22, 1997, relates to a Central Processing Unit (CPU) mounting structure that includes a U-shaped mounting frame mounted on an electrical connector that receives a CPU card. The CPU card is held in the U-shaped mounting frame by two holding down devices, i.e., screws. The mounting structure, which is intended for use with CPUs, makes unusable a sizeable amount of space on the circuit board as the U-shaped structure extends on three sides of the board. The U-shaped structure also does not allow interface access to the printed circuit card on the sides.

Yet another example, U.S. Pat. No. 4,826,447, issued to Forker et al. on May 2, 1989, relates to a retainer for locking a printed circuit board with an edge connector that is directly soldered to the conductive paths on a second circuit board. The circuit board is permanently connected to the connector and is removable only after disengaging the retainer and desoldering the electrical connections to the second circuit board. The retainer, which does not allow interface access to the printed circuit card on the sides, requires a large surface area of potentially usable circuit board space.

Thus, there is a need for a sturdy and reliable printed circuit card retention mechanism that is easy to engage and disengage and does not require desoldering of connections. There is a further need for a printed circuit card retention mechanism that does not damage the printed circuit card when the retention mechanism is engaged and disengaged. There is yet a further need for a printed circuit card retention mechanism that occupies a minimum of the usable surface area on the printed circuit card and allows for access to connection apparatus on all four sides of the printed circuit card.

SUMMARY OF THE INVENTION

According to an embodiment of the present invention, a circuit card retention mechanism is provided including a base and at least one pivot arm extending from the base. At least one finger is provided extending from the at least one pivot arm to secure the pivot arm to one of a circuit card and a main circuit board.

DETAILED DESCRIPTION

FIGS. 1 to 7 illustrate a printed circuit card retention mechanism that secures an electrical connector of a printed circuit card to an electrical connector on a main circuit board. The Figures show a printed circuit card with an edge card type electrical connector and a main circuit board with a receptacle type electrical connector, according to an embodiment of the present invention. The retention mechanism may be composed of plastic or any other nonconductive material.

Figure 1:
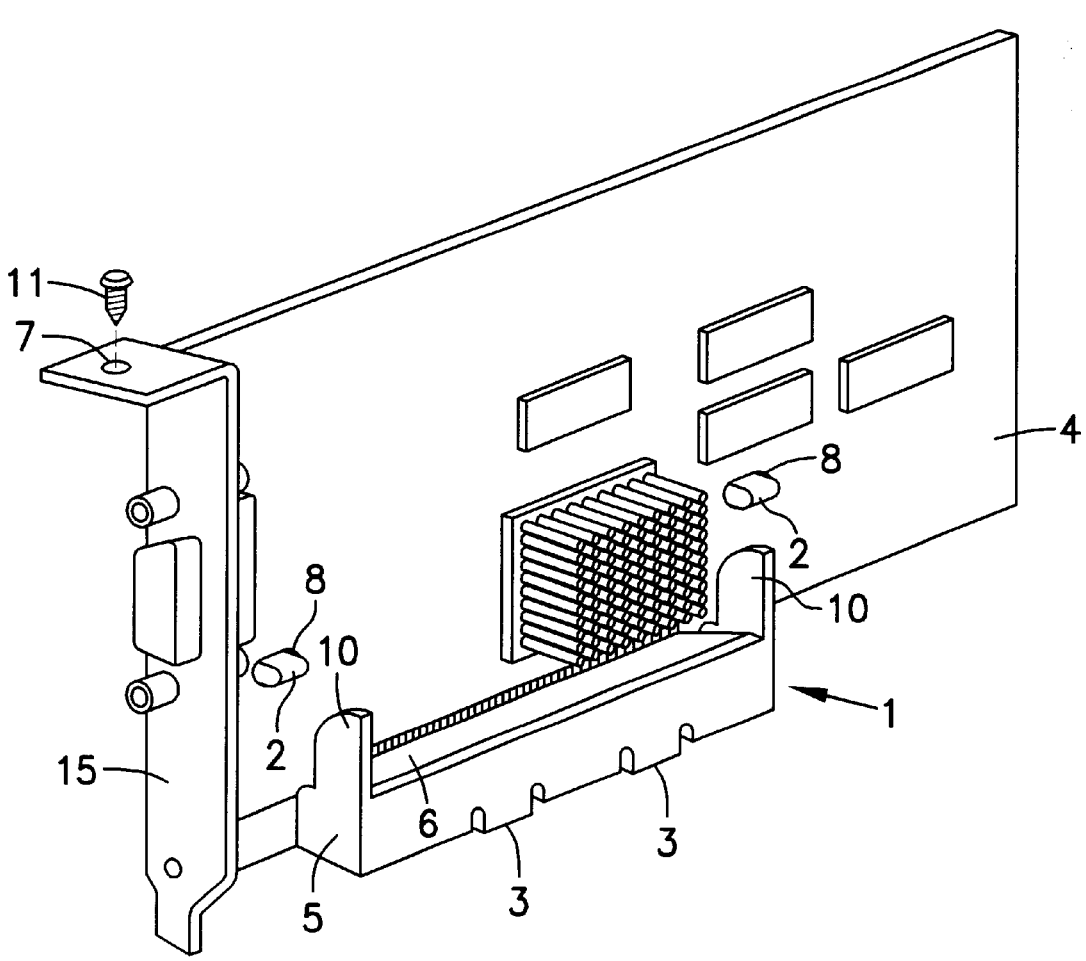
FIG. 1 shows a perspective view of the front side of the retention mechanism installed and secured to a printed circuit card, according to an embodiment of the present invention.

Referring to FIG. 1, a printed circuit card 4 is shown secured by the printed circuit card retention mechanism 1. The fingers 2 of the retention mechanism 1 latch into the notches 8 cut into or through the printed circuit card 4. Two support members 10, that extend from base 5, provide pressure to the printed circuit card 4 in opposition to the fingers 2. A fastening device 11 enters the opening 7 on side plate 15 to secure the printed circuit card 4 to the equipment chassis (not shown). The base 5 of retention mechanism 1 straddles and clips onto the existing receptacle type connector 6 using two sets of ledges 3.

Figure 2A:
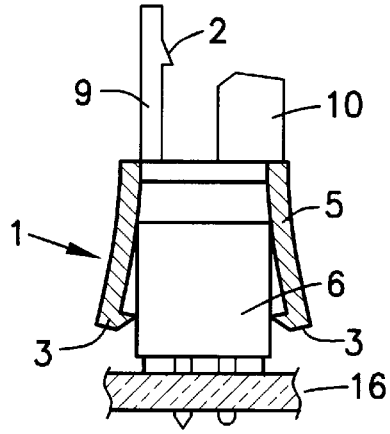
FIGS. 2(A) and 2(B) show a side view of the installation of the base of the retention mechanism onto an electrical connector located on a main circuit board, according to an embodiment of the present invention.
Figure 2B:
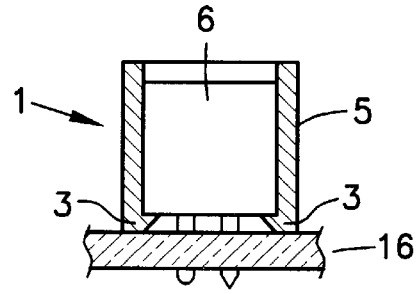
Figure 3:
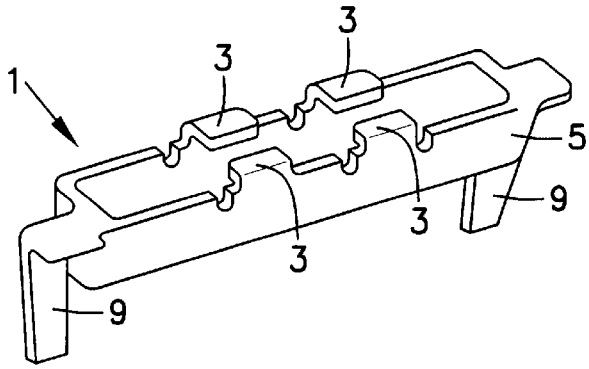
FIG. 3 shows a bottom view of the retention mechanism with two sets of complementary ledges, according to an embodiment of the present invention.

As specifically shown in FIGS. 2(A), 2(B) and 3, the two sets of ledges 3 located on the bottom of the base 5 of retention mechanism 1 straddle the receptacle type connector 6, which is soldered into the main circuit board 16. As the base 5 is lowered onto the receptacle type connector 6, the ledges 3 cause the retention mechanism 1 to be displaced outward as shown in FIG. 2(A). When the base is completely in place, the ledges 3 snap back and lock under the receptacle type connector 6, securing it in place as shown in FIG. 2(B).

Figure 4A:
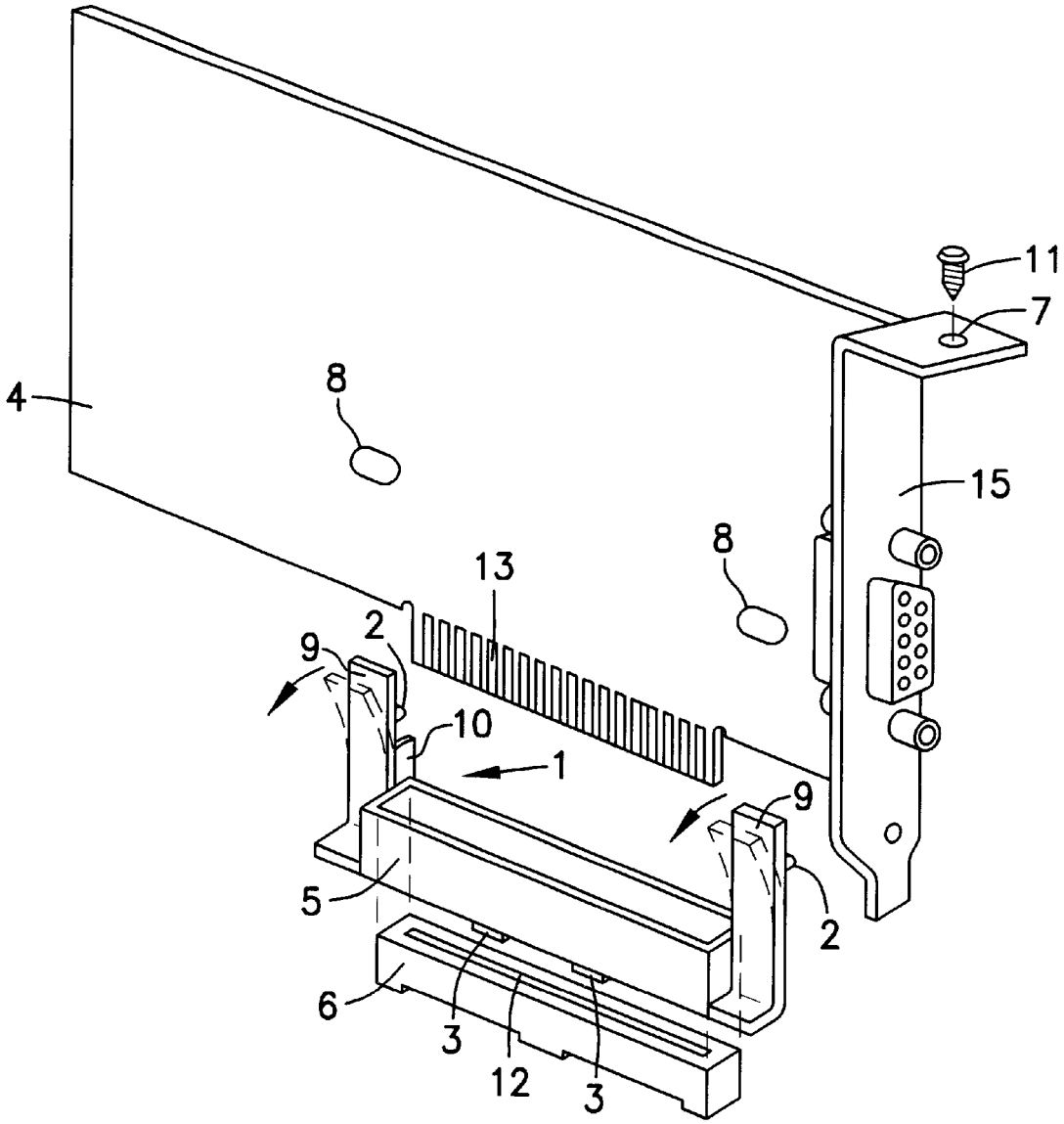
FIGS. 4(A) and 4(B) show a perspective view of the rear side of the retention mechanism illustrating the installation procedure of the retention mechanism and printed circuit card, according to two embodiments of the present invention.
Figure 4B:
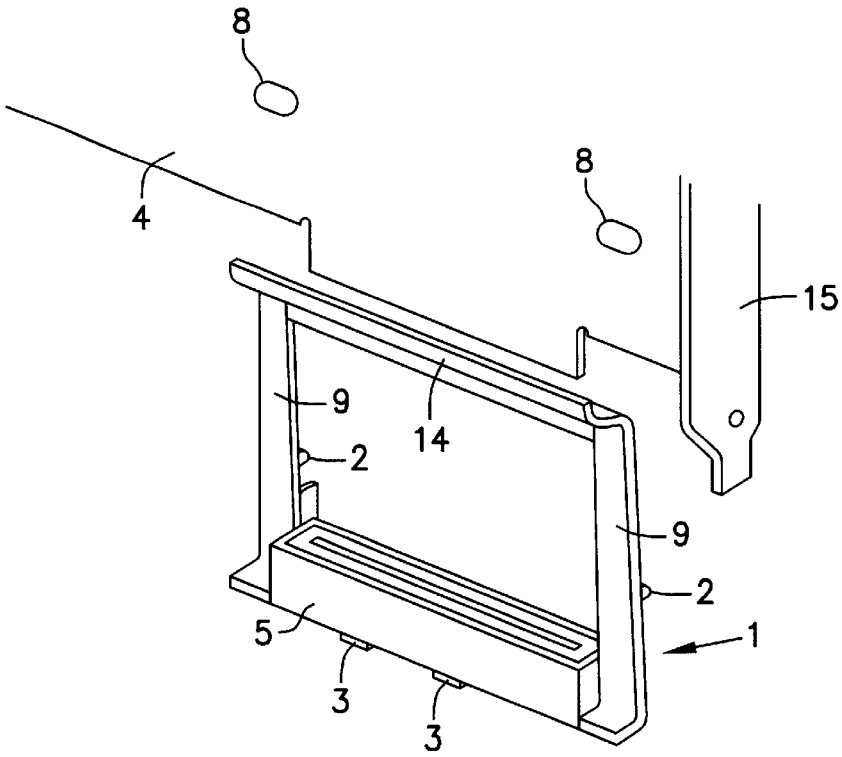

Referring to FIGS. 4(A) and 4(B), the printed circuit card 4 is shown being installed into the retention mechanism 1, which itself is secured to receptacle type connector 6 via ledges 3. One embodiment of the present invention is shown in FIG. 4(A). To install the printed circuit card 4, both pivot arms 9 are pulled away from the printed circuit card 4 while the edge card connector 13 slides into and mates with the contacts 12 of the receptacle type connector 6. As the connectors 6 and 13 electrically connect, fingers 2 latch into notches 8 cut into or through printed circuit card 4 thereby securing the electrical connection. The fastening device 11 is used to further secure side plate 15 to the equipment chassis (not shown).

In an alternative embodiment of the present invention, as shown in FIG. 4(B), the pivot arms 9 are themselves jointly connected to pivot bar 14. This embodiment allows for easier printed circuit card installation and removal, as pressure on the pivot bar 14 away from printed circuit card 4 releases both fingers 2 on pivot arms 9 from notches 8. Also, when inserting the printed circuit card 4 into the receptacle type connector 6, pushing back on the pivot bar 14 until the card is substantially in place avoids having the fingers 2 on the pivot arms 9 rub against the printed circuit card 4 thereby avoiding damage to the card.

Figure 5:
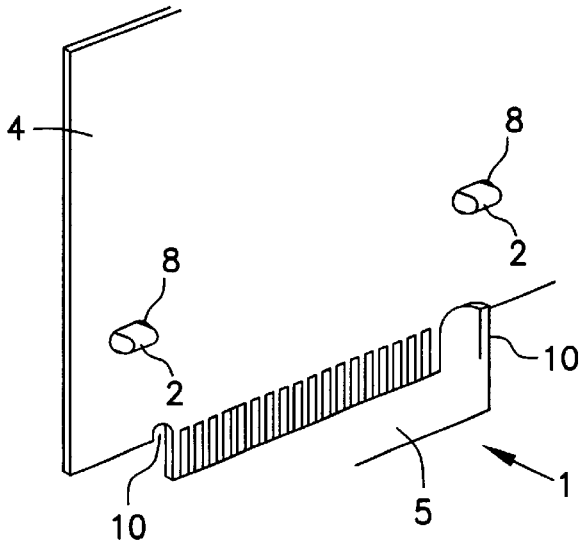
FIG. 5 shows a simplified perspective view of the front side of the retention mechanism installed and secured to a printed circuit card, according to an embodiment of the present invention.

As is illustrated further in FIG. 5, when the printed circuit card is properly installed, the fingers 2 on retention mechanism 1 latch into notches 8 on printed circuit card 4. Further, the two support members 10 that extend from base 5 provide pressure to the printed circuit card 4 in opposition to the fingers 2.

Referring back to FIGS. 4(A) and 4(B), the printed circuit card is removed by first removing fastening device 11 and then pulling the pivot arms 9 away from the notches 8 while lifting the printed circuit card 4 out of the receptacle type connector 6.

Figure 6A:
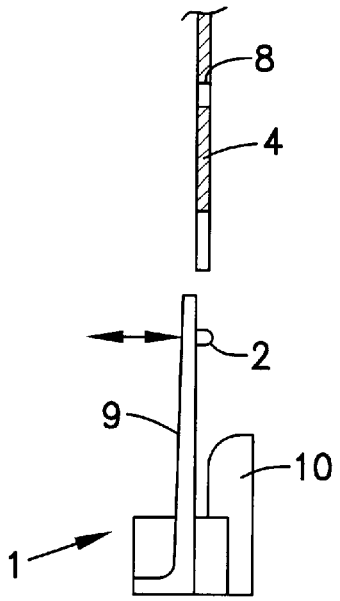
FIGS. 6(A) and 6(B) show a side view of the retention mechanism illustrating the installation procedure of a printed circuit card, according to two embodiments of the present invention.
Figure 6B:
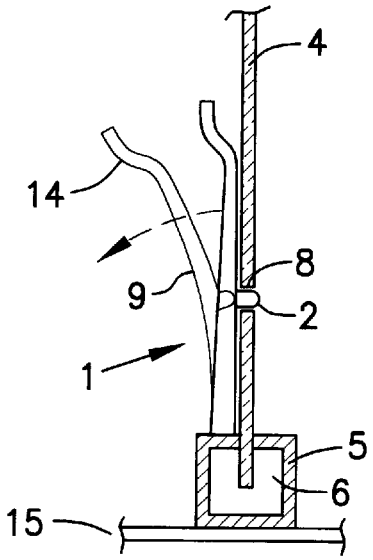

FIGS. 6(A) and 6(B) show a side view of the installation procedure for a printed circuit card according to two embodiments of the present invention. In one embodiment, as shown in FIG. 6(A), pivot arm 9 is pulled back while inserting printed circuit card 4 into receptacle type connector 6. When printed circuit card 4 is electrically mated with receptacle type connector 6, the pivot arm 9 is released allowing the fingers 2 to engage notches 8 firmly holding printed circuit card 4 in place.

In the alternative embodiment, as shown in FIG. 6(B), the pivot arms 9 are jointly connected to pivot bar 14, which allows for easier printed circuit card installation and removal.

Figure 7A:
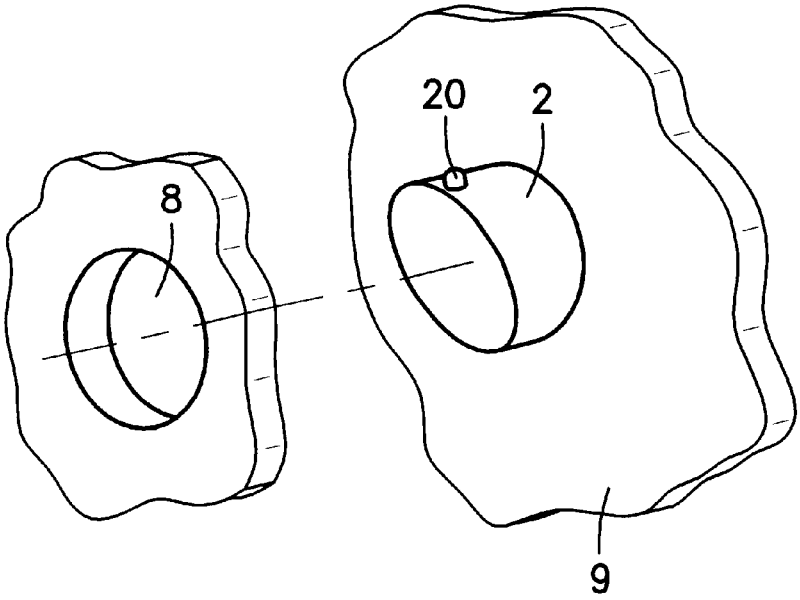
FIGS. 7(A) and 7(B) show an alternative embodiment of the shapes of the finger extending from the pivot arm and notch located in the circuit board, according to an embodiment of the present invention.
Figure 7B:
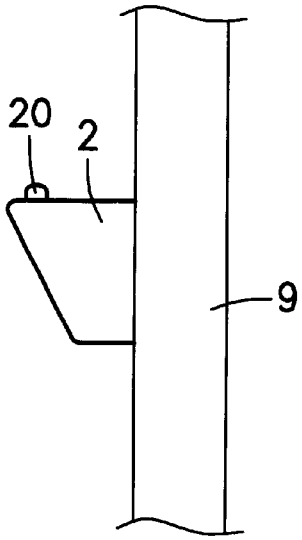

In yet another alternative embodiment, as shown in FIGS. 7(A) and 7(B), both the notches 8 and the fingers 2 could be circular in shape. Further, the fingers 2 can be angled such to create a ramp on their ends that allow the pivot arms 9 to pivot away from the circuit board 4, without the need for manual manipulation, before allowing the finger 2 to snap into place in the notch 8. In other words, the ramp allows the circuit board to be installed without pulling back on the pivot arms.

It is to be understood, of course, that a number of variations from the present invention as disclosed herein are realizable. First, the retention mechanism could be used to maintain electrical connection between two printed circuit cards, two main circuit boards, or any collection of electronic circuitry in two discrete locations that are electrically connected.

Second, the connectors used to electrically connect the printed circuit boards may differ from those disclosed herein. The Figures and accompanying discussion describe a printed circuit card retention mechanism that maintains electrical connection between an edge card connector on a printed circuit card and a receptacle type connector on a main circuit board. However, the retention mechanism could be used in conjunction with other connection apparatus, including, but not limited to, a main circuit board with an edge card connector and a printed circuit card with a receptacle type connector.

Third, the securing apparatus for connecting the retention mechanism 1 to the main circuit board connector 6 may differ. For example, one set of ledges 3 may be used to straddle connector 6 or the retention mechanism 1 could latch into additional notches located on the main circuit board.

Fourth, a single pivot arm 9 with a single finger 2 or a plurality of fingers 2 may be used to secure the printed circuit card 4 to the electrical connector 6 on the main circuit board 16.

Fifth, the fingers 2 may be installed on the printed circuit card 4 and the notches 8 may be located on the pivot arms 9. This could be used to further avoid potential damage to the printed circuit card during installation and removal.

Sixth, the notches 8 need not be cut through the printed circuit card 4 as is illustrated by the Figures. The notches 8 can be indentations in the printed circuit card that are not cut through the card, but serve the same purpose of maintaining the electrical connection.

In addition, while the application of the present invention to computer equipment, such as PC's and computer servers, is unmistakable, the present invention may apply to any type of electronic equipment where two discrete printed circuit cards are electrically connected. This includes, but is not limited to, telecommunications equipment such as line interface cards, transceivers, power modules, and switch modules.

It is to be understood and expected that additional variations in the principles of construction herein disclosed may be made by one skilled in the art and it is intended that such modifications, changes, and substitutions are to be included within the scope of the present invention.

What is claimed is:

1. A circuit card retention mechanism for securing an electrical connection between a circuit card and a main circuit board, comprising:

a base through which an electrical connector for each of the printed circuit card and the main circuit board fits;

at least one set of ledges connected at a bottom of the base on opposite sides, such that each ledge of the set is directly opposite the other, and which in unison snap-lock onto an electrical connector of the main circuit board;

at least one pivot arm extending from the base and which is biased towards the printed circuit card;

at least one finger extending from the at least one pivot arm and which latches into at least one notch in the printed circuit card;

at least one non-moving rigid support member which extends from the base and provides pressure to the printed circuit card in opposition to the at least one pivot arm; and a side plate, to which the printed circuit card is connected, and which has an opening through which a fastening device can be inserted.

2. The circuit card retention mechanism in accordance with claim 1, wherein the circuit card is installed by pulling back the at least one pivot arm and guiding the electrical connector of the circuit card through the base to mate with the electrical connector of the main circuit board.

3. The circuit card retention mechanism in accordance with claim 1, further comprising:

a pivot bar connected between a first one and a second one of the at least one pivot arm such that pressure on the pivot bar in the direction away from the circuit card releases the at least one finger extending from the at least one pivot arm.

4. The circuit card retention mechanism in accordance with claim 1, wherein the at least one notch cuts through the circuit card allowing the at least one finger extending from the at least one pivot arm to snap onto the circuit card.

5. The circuit card retention mechanism in accordance with claim 1, wherein the at least one pivot arm extends from the base on a side which is opposite of components on the circuit card.

6. The circuit card retention mechanism in accordance with claim 1, wherein the at least one finger has a rounded end.

7. The circuit card retention mechanism in accordance with claim 1, wherein the at least one finger is angled at an end such that a ramp is created at the end.

8. A circuit card retention mechanism, comprising:

a base;

at least one pivot arm extending from the base;

at least one finger extending from the at least one pivot arm to secure the pivot arm to one of a circuit card and a main circuit board;

at least one non-moving rigid support member extending from the base and which provides pressure to one of the circuit card and the main circuit board in opposition to the at least one pivot arm; and a side plate, to which the printed circuit card is connected, and which has an opening through which a fastening device can be inserted.

9. The circuit card retention mechanism in accordance with claim 8, wherein the finger engages at least one notch on one of the circuit card and the main circuit board.

10. A circuit card retention mechanism, comprising:

a base;

at least one pivot arm extending from the base;

at least one notch located in the at least one pivot arm; and at least one finger extending from one of a circuit card and a main circuit board fitting into said at least one notch.

11. A printed circuit card retention mechanism for electrically connecting a printed circuit card to a main circuit board, where the printed circuit card and the main circuit board each contain at least one connector for connecting electrically to each other, comprising:

a base, the base further including:

a securing apparatus to secure the retention mechanism to the at least one electrical connector on the main circuit board;

at least one pivot arm extending from the base;

at least one finger extending from the at least one pivot arm;

at least one non-moving rigid support member extending from the base; and a side plate, to which the printed circuit card is connected, and which has an opening through which a fastening device can be inserted;

wherein the at least one finger engages at least one notch on the printed circuit card so as to secure the electrical connector on the printed circuit card to the electrical connector on the main circuit board, and wherein the at least one non-moving rigid support member provides pressure to the printed circuit card in opposition to the at least one pivot arm.

12. The printed circuit card retention mechanism in accordance with claim 11, wherein the at least one electrical connector on the printed circuit card is an edge card connector and the at least one electrical connector on the main circuit board is a receptacle type connector for receiving an edge card connector.

13. The printed circuit card retention mechanism in accordance with claim 11, wherein the at least one electrical connector on the main circuit board is an edge card connector and the at least one electrical connector on the printed circuit card is a receptacle type connector for receiving an edge card connector.

14. The printed circuit card retention mechanism in accordance with claim 11, wherein the at least one pivot arm is connected to another pivot arm by a pivot bar.

15. The printed circuit card retention mechanism in accordance with claim 11, wherein the retention mechanism is composed of plastic.

16. The printed circuit card retention mechanism in accordance with claim 11, wherein the retention mechanism is located in computer based equipment.

17. The printed circuit card retention mechanism in accordance with claim 11, wherein the retention mechanism is located in telecommunications equipment.

* * * * *

UNITED STATES PATENT AND TRADEMARK OFFICE

CERTIFICATE OF CORRECTION

PATENT NO. : 6,358,079 B1
DATED : March 19, 2002
INVENTOR(S) : Scott L. Noble

It is certified that error appears in the above-identified patent and that said Letters Patent is hereby corrected as shown below:

Column 4,
Line 27, insert -- Further, in one embodiment a protruberance 20 may be provided to limit disturbance of soldered connections and printed circuit card components. --

Signed and Sealed this

Eighteenth Day of November, 2003

JAMES E. ROGAN
*Director of the United States Patent and Trademark Office*